US006655224B1

(12) United States Patent
Ji et al.

(10) Patent No.: US 6,655,224 B1
(45) Date of Patent: Dec. 2, 2003

(54) DOWNWARD OFFSET BARBELL TYPE WALKING BEAM COMPOSITIVELY BALANCE OIL PUMP

(75) Inventors: Xiangyun Ji, Wulumuqi (CN); Shengeun Yu, Wulumuqi (CN); Renquan Luo, Wulumuqi (CN); Weidong Zhao, Wulumuqi (CN); Yuzhen Wei, Wulumuqi (CN); Wuanjiany Zhang, Wulumuqi (CN)

(73) Assignee: No. 3 Machine Tool Plant of the Xinjiang, The Xinjiang of the Uygur Autonomous Region (CN)

( * ) Notice: Subject to any disclaimer, the term of this patent is extended or adjusted under 35 U.S.C. 154(b) by 0 days.

(21) Appl. No.: 09/605,248

(22) Filed: Jun. 28, 2000

(51) Int. Cl.[7] ..... F16H 21/20; F04B 49/00
(52) U.S. Cl. ..... 74/41; 417/328
(58) Field of Search ..... 74/41; 417/328

(56) References Cited

U.S. PATENT DOCUMENTS 1,146,404 A * 7/1915 Coffman ..... 74/41
1,751,767 A * 3/1930 Sperry ..... 74/41
1,948,288 A * 2/1934 Corey ..... 74/41
2,877,652 A * 3/1959 Muschalek ..... 74/41
4,534,168 A * 8/1985 Brantly ..... 417/904

* cited by examiner

*Primary Examiner*—William C Joyce
(74) *Attorney, Agent, or Firm*—Dougherty, Clements & Hofer

(57) ABSTRACT

A downward offset barbell type walking beam compositively balance oil pump, in which at the rear end of the walking beam is mounted a downward offset barbell type balancing device consisting of a shoe plate, a cross shaft and balancing pieces, retains most of the structure of the conventional walking beam oil pump, and has a compact structure, a wide range of moment change, an advantage of saving electricity to a degree of more than 40 percent, and is safe and reliable for operation. The present invention can be applied to the renovation of variety of conventional walking beam oil pumps, used in oil fields, outphase crankshaft oil pumps and walking beam compositively balance oil pumps for the purpose of energy-saving or of promotion of the capacity for oil extraction of the above-mentioned oil pumps.

4 Claims, 7 Drawing Sheets

DOWNWARD OFFSET BARBELL TYPE WALKING BEAM COMPOSITIVELY BALANCE OIL PUMP

FIELD OF THE INVENTION

The present invention relates to a new type of energy-saving oil pump which is widely used in the oil industry. It is a new type of walking beam oil pump designed to save energy.

BACKGROUND OF THE INVENTION

As a major instrument used for oil extraction in oilfields, the design of the walking beam oil pump is forced to adopt a dynamo with excessive power because of its poor balance effect and the high pitch of strand of the peak value, thus resulting in the waste of energy and shortage of electricity supply. Therefore, the lowering of consumption and the saving of energy have become the major considerations in the refinement of the oil pump. As a result, a variety of energy-saving oil pumps have been created, such as apron conveyor, flight conveyor, and heterotype walking beam machine, and so on. However, because of the complex structure of these machines, the essential components lack reliability, therefore making it difficult for market promotion.

The objectives of the present invention are as follows: 1. To provide a new type of walking beam oil pump that retains the original structure and is capable of saving energy and increasing the capacity for elevation, 2. To offer a renovation of the conventional walking beam oil pump.

BRIEF SUMMARY OF THE INVENTION

The aim of the present invention is realized through the following steps: a downward offset barbell type balancing device consisting of a shoe plate, a cross shaft and a balance piece is mounted at the rear end of the walking beam; the said shoe plate is mounted at the lower part of the end of the walking beam; the cross shaft is installed on the shoe plate, and balancing pieces are suspended on either side of the shoe plate thus forming a barbell.

In the oil pumping process of the present invention, the gravity center of the barbell-type balancing device at the end of the walking beam lies on the horizontal line through the rotatory centre of the walking beam due to its displacement, thus producing the biggest moment of force of the balancing weight, which, in collaboration with the balancing moment of force of the crank shaft, effectively reduces the pitch of strand of the peak value during the oil pumping process, thus achieves the optimal effect of combined balancing, which cannot be realized by the conventional combined balance walking beam oil pumps.

Below is a detailed description of the present invention with a reference to the accompanying drawings and the following embodiments.

DETAILED DESCRIPTION OF THE INVENTION

Embodiment 1

Figure 2:
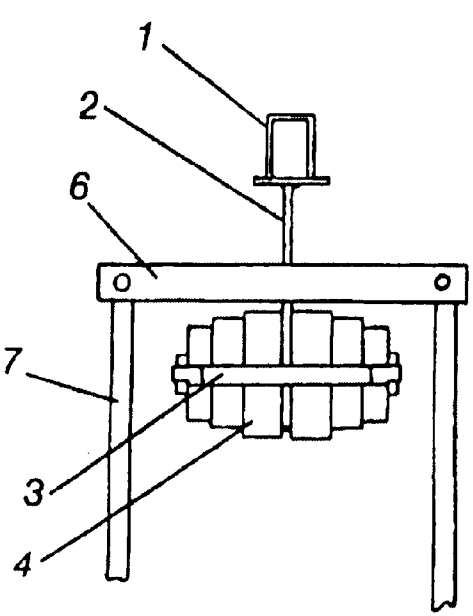
FIG. 2 is a view of FIG. 1 seen from the direction of k-k.
Figure 1:
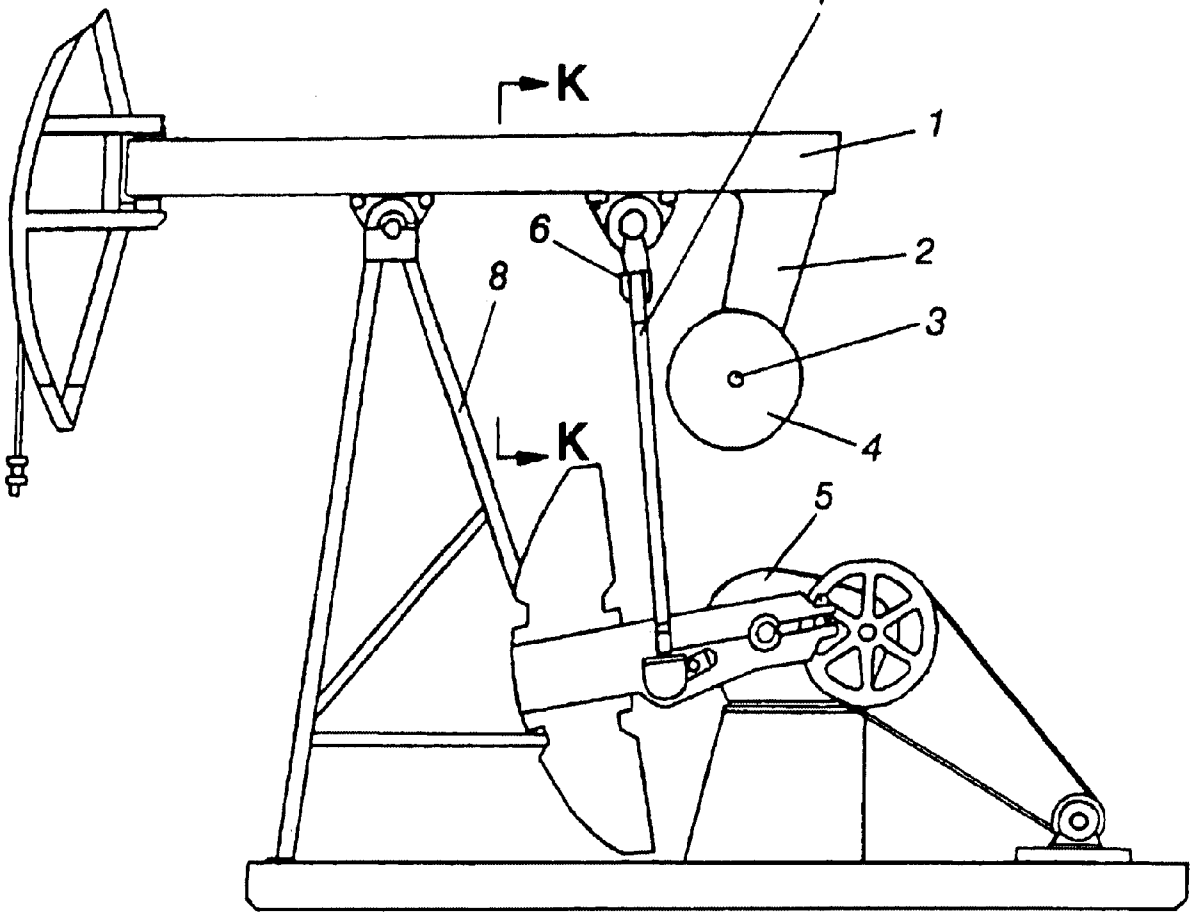
FIG. 1 offers a structural view of the present invention.
Figure 3:
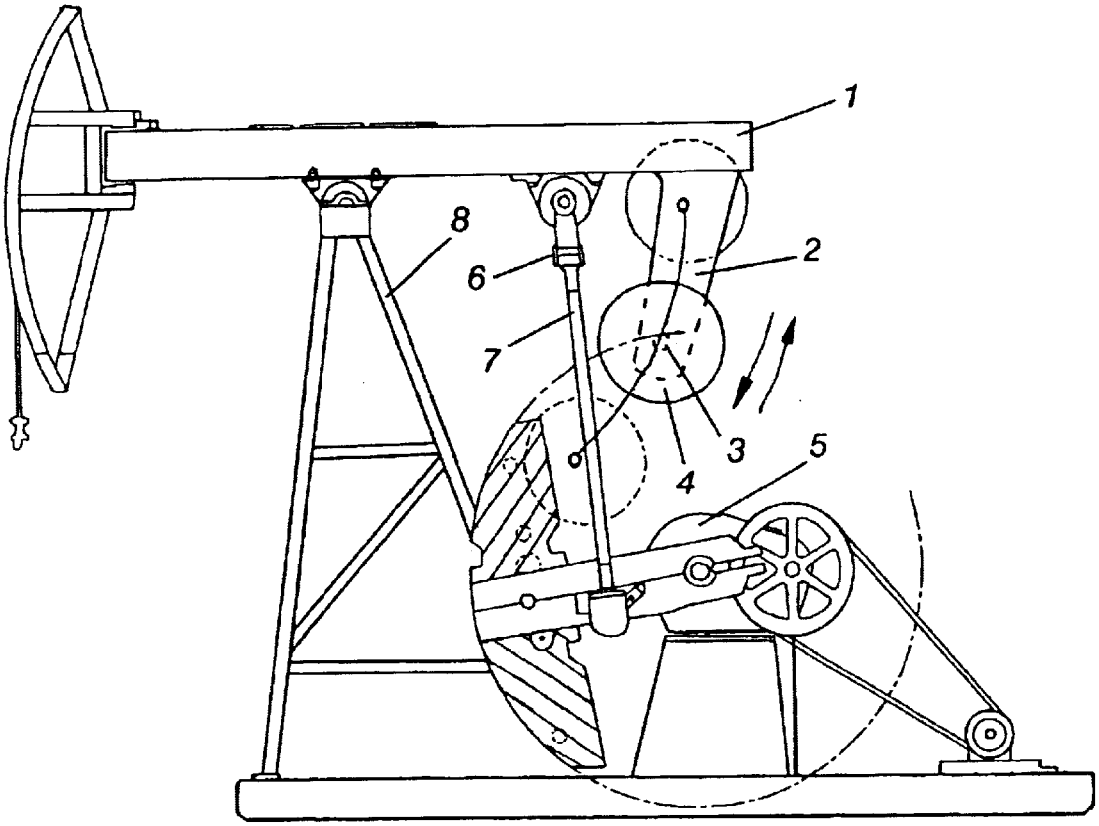
FIG. 3 shows the orbit of movement of the balancing piece of the present invention.
Figure 5:
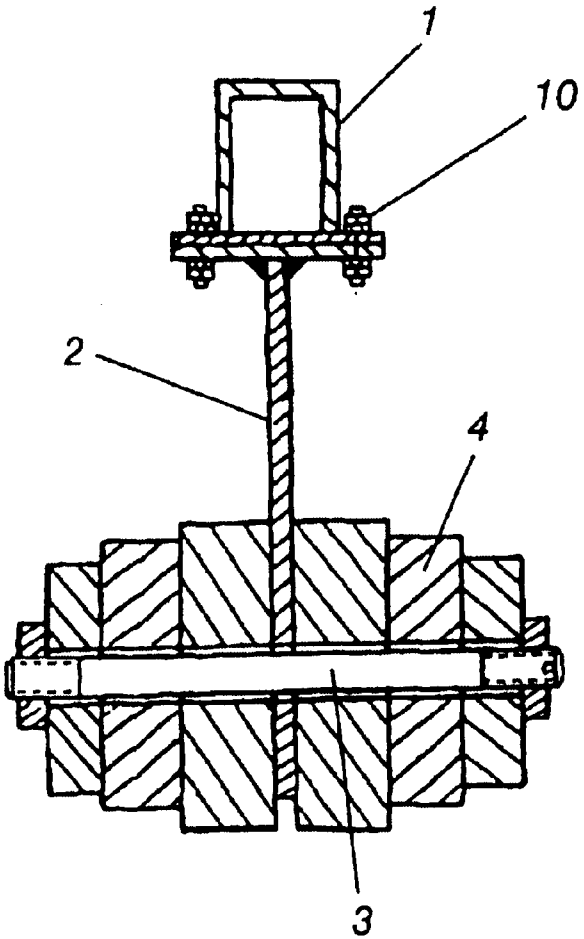
FIG. 5 is a side view of FIG. 4.
Figure 4:
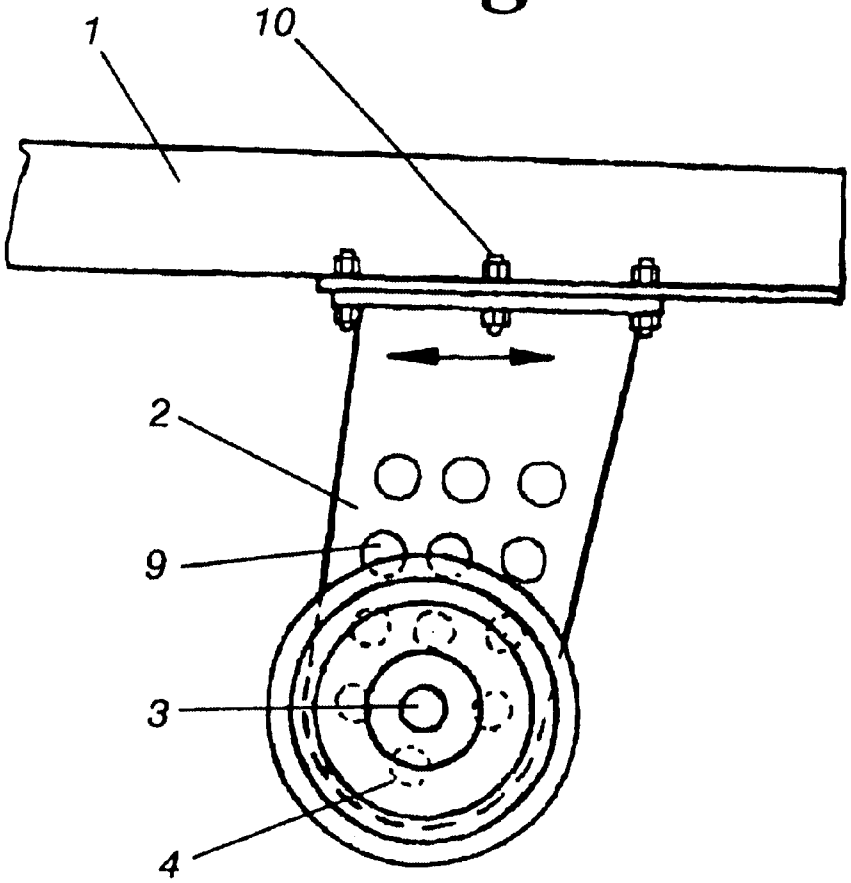
FIG. 4 is a front view of the end part of the walking beam with a biased balancing piece according to embodiment 1.
Figure 7:
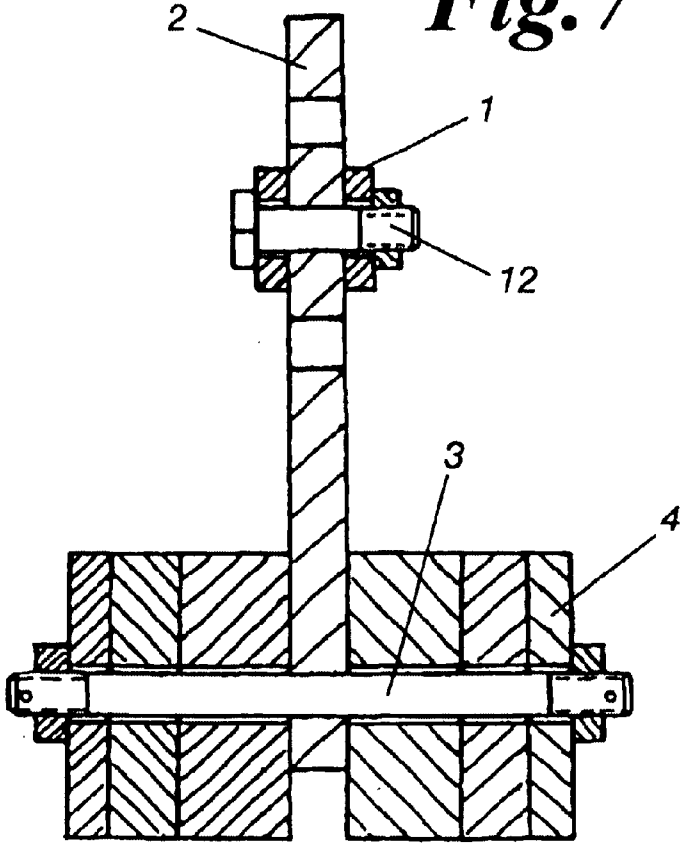
FIG. 7 is a side view of FIG. 6.
Figure 6:
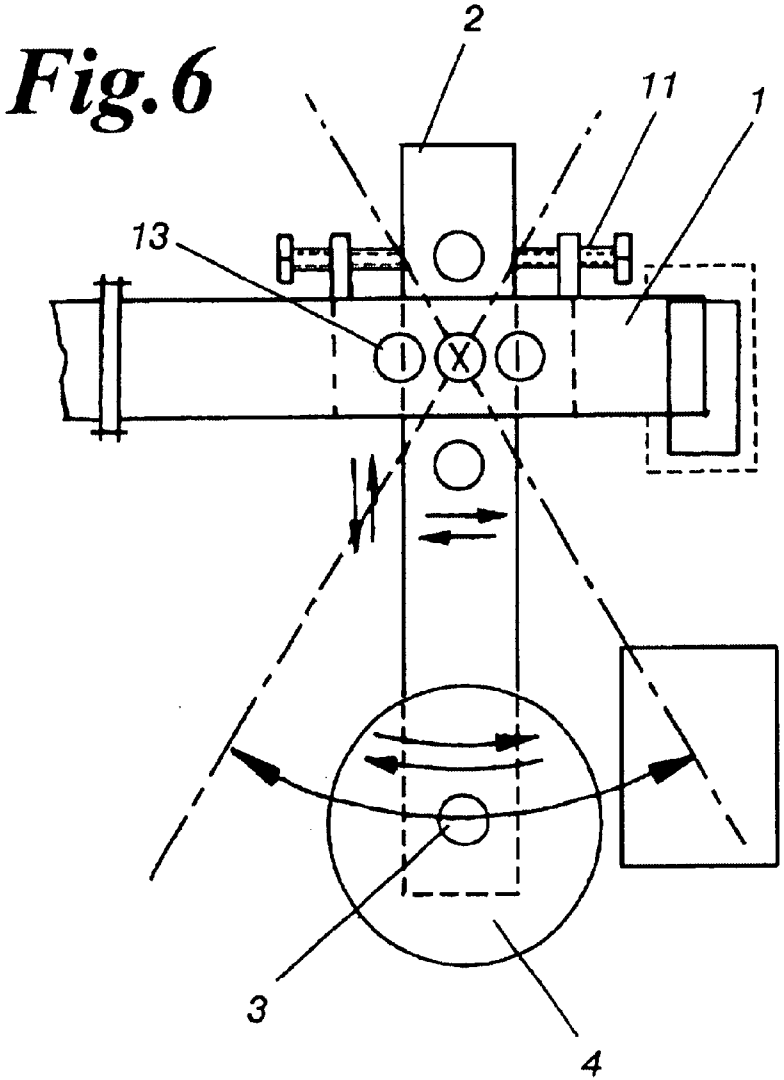
FIG. 6 is a front view of the end part of the walking beam with a biased balancing piece according to embodiment 2.
Figure 9:
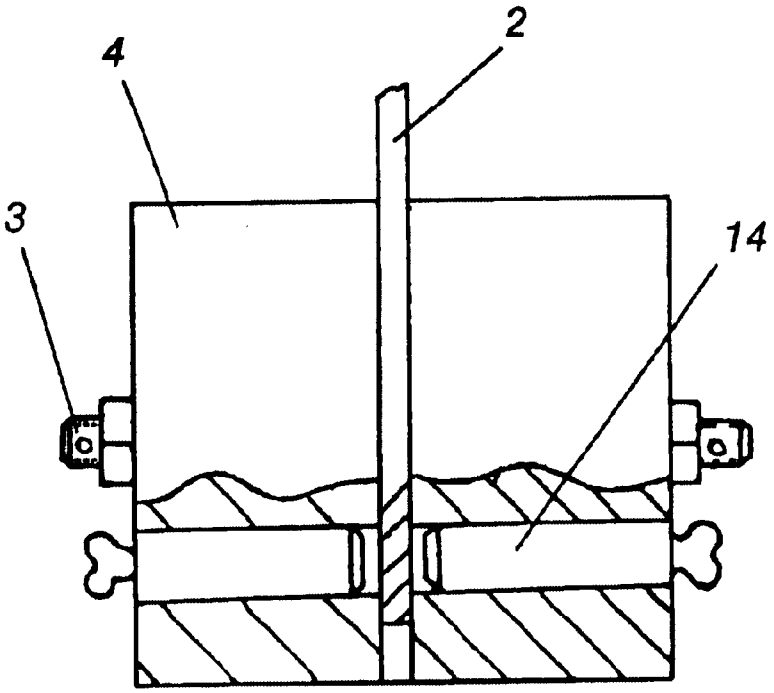
FIG. 9 is a side view of FIG. 8.
Figure 8:
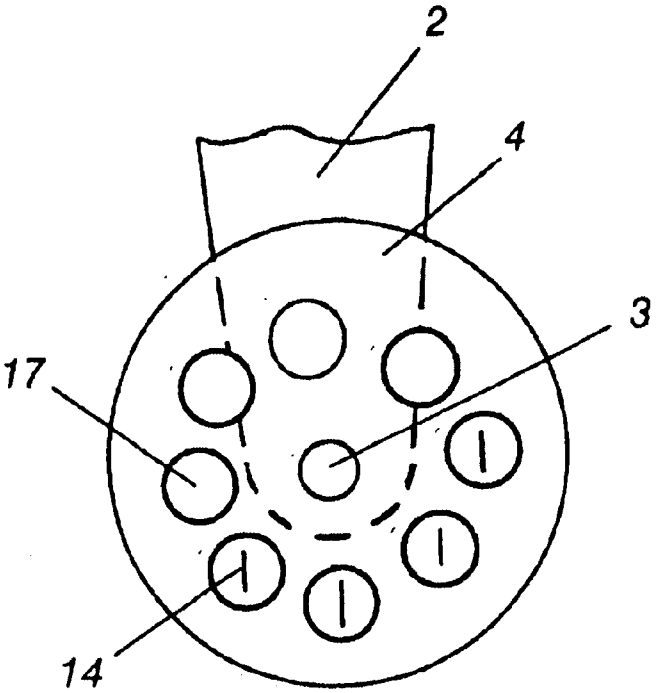
FIG. 8 is a front view of the barycentre-adjustable biased balancing piece according to embodiment 3.
Figure 10:
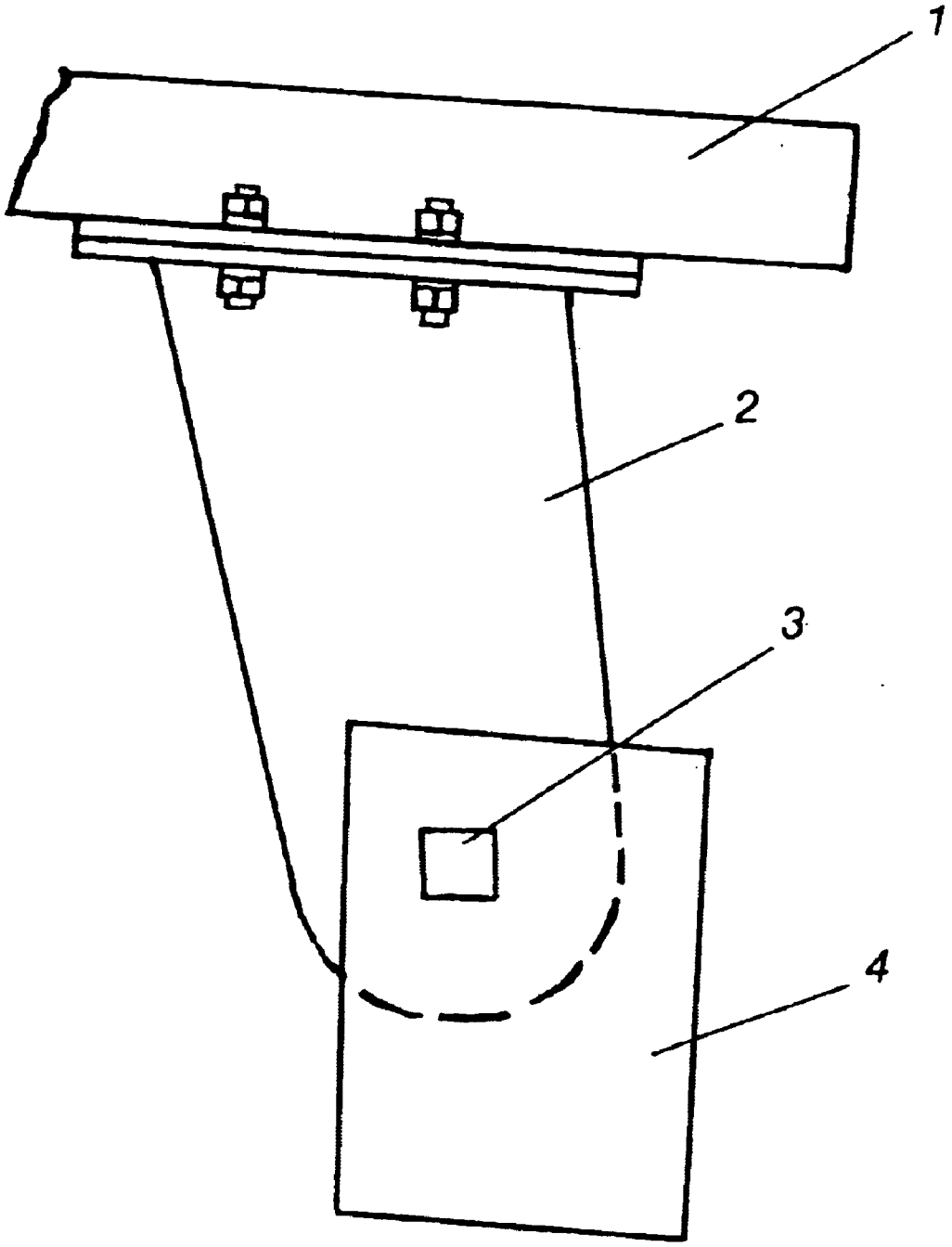
FIG. 10 is a front view of the end part of the walking beam with a biased balancing piece according to embodiment 4.
Figure 11:
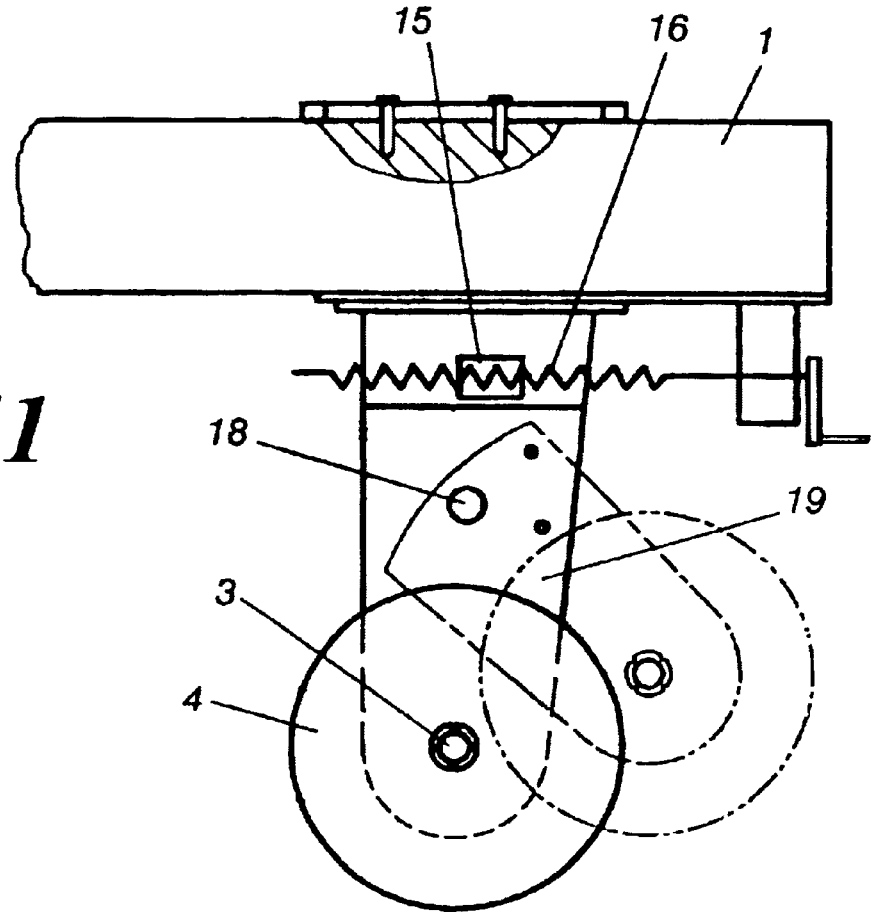
FIG. 11 is a front view of the end part of the walking beam with a biased balancing piece according to embodiment 5.
Figure 12:
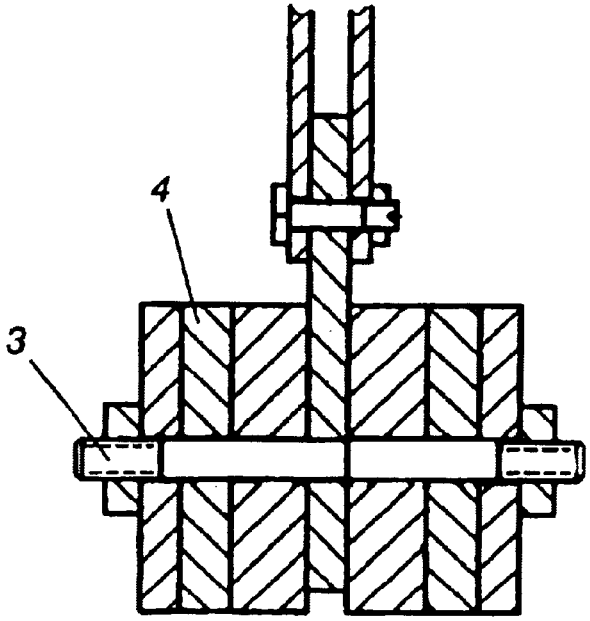
FIG. 12 is a side view of FIG. 11.

The shoe plate 2 is fastened to the lower part of the end of the walking beam 1 through a bolt 10. The shoe plate 2 is set in motion against the walking beam 1 according to the need of the variety of moment. Several localizing apertures 9 are bored on the shoe plate 2 and the cross shaft 3 is inserted into the localizing apertures 9 in the shoe plate 2. The balancing pieces 4 are suspended on the cross shaft 3 at both sides of the shoe plate 2 thus forming a barbell, to achieve the variation of moment of force through the change of the gravity center and through the increase or decrease of the weight of the pieces.

Embodiment 2

An adjusting bolt 11 is installed on the walking beam 1, at whose end are bored several connecting holes 13 horizontally. Connecting holes 13 are also arranged vertically on the shoe plate 2. The walking beam 1 and the shoe plate 2 are hinged together by the bolt 12 through the connecting holes 13. The relative positions of the walking beam 1 and the shoe plate 2 can be altered through the connecting holes 13 to alter the moment of force. The alteration of the moment of force can also be achieved when the adjusting bolt 11 changes the hinging direction between the shoe plate 2 and the walking beam 1.

Embodiment 3

The barbell type balancing pieces 4 are fixed on the shoe plate 2, and several holes 17 are located axially on the pieces 4. The change of the moment can be achieved through the displacement of the gravity center of the balancing pieces 4 by changing the position of the mandrils 14 in the holes 17 or through the increase or reduction of the number of the mandrils 14.

Embodiment 4

A locating cross shaft 3 which corresponds with the holes of the balancing pieces 4 is mounted on the lower part of the shoe plate 2 so that the change of the moment can be achieved by varying the position of suspension of the balancing pieces 4.

Embodiment 5

The shoe plate 2 is mounted at the rear part of the walking beam 1 on which a lead screw 16 is installed. A bolt 15 is mounted on the shoe plate 2, which can be made to move on the walking beam 1 by shaking the lead screw 16 so as to achieve the change of the moment of force. The moveable shoe plate 19 is hinged on the shoe plate 2 through a pintle

18. Balancing pieces 4 are suspended on either side of the moveable shoe plate 19 through a cross shaft 3. The moveable shoe plate 19 can rotate around the pintle 18 so as to achieve the change of the moment of force.

In the operation of the downward offset barbell type walking beam compositively balance oil pump according to the present invention, the orbit of the gravity center of the barbell type balancing device at the end of the walking beam 1 forms an arc. When the gravity center occurs on the horizontal line through the rotatory center of the walking beam, the gravitation moment of the balancing device reaches the highest, and when the gravity center approaches the vertical line through the rotatory center of the walking beam, the gravitation moment of the balancing device is the least. The present invention employs this principle of moment change to make the combined function of the gravity moment of the balancing device and the crankshaft balance satisfy the requirements for the change of moment during the oil pumping process of the oil pump and achieve the purpose of the reduction of the peak value of the moment torsion. The balancing device takes the shape of a barbell so that its moment can be changed freely and furthermore, it takes full advantage of the valid space among the decelerator 5, the crossbeam 6, the connecting rod 7 and the trestle 8, thus provides sufficient downward offset for the gravity center of the barbell type balancing device and guarantees the optimal choice of the position of the gravity center. Moreover, it also has sufficient space for suspending more balancing pieces in order to meet the demand of the balance of the moment.

In addition, the present invention can be applied to the renovation of a variety of conventional walking beam oil pumps used in oilfields, outphase crankshaft oil pumps and walking beam compositively balance oil pumps for the purpose of energy-saving or of promotion of the capacity for oil extraction of the above-mentioned oil pumps. The renovated pump with a conventional type-3 walking beam, for example, can reach the working property of the type-4 pump without the driving dynamo being changed. It has a compact structure, a wide range of moment change and an advantage of saving electricity to a degree of more than 40 percent and its is safe and reliable for operation.

What is claimed:

1. A downward offset barbell walking beam compositively balanced oil pump, is characterized in that, at the rear end of the walking beam (1) is mounted a downward offset barbell balancing device comprising a shoe plate (2), a cross shaft (3) and balancing pieces (4), in which the shoe plate (2) is mounted at and fastened to the lower part of the end of the walking beam (1); the cross shaft (3) is installed on the shoe plate (2), balancing pieces (4) are suspended on the cross shaft (3) on either side of the shoe plate (2) forming a barbell, and said shoe plate (2) includes a plurality of localizing apertures (9) allowing the barbell to be adjusted relative to the walking beam (1).

2. A downward offset barbell walking beam compositively balanced oil pump according to claim 1, wherein the shoe plate (2) is fastened to the lower part of the end of the walking beam (1); and wherein said shoe plate (2) includes a plurality of localizing apertures (9) allowing the barbell to be adjusted relative to the walking beam (1).

3. A downward offset barbell walking beam compositively balanced oil pump according to claim 1, wherein the cross shaft (3) is inserted into said plurality of localizing apertures (9), thereby helping suspend the balancing pieces (4) on the cross shaft (3) from both sides of the shoe plate (2) forming the bar bell.

4. A downward offset barbell walking beam compositively balanced oil pump according to claim 1, wherein said shoe plate (2) is fastened to the lower part of the end of the walking beam (1) by a bolt.

* * * * *